US005428378A

United States Patent [19]

Murata et al.

[11] Patent Number: 5,428,378

[45] Date of Patent: Jun. 27, 1995

[54] INK JET RECORDING DEVICE AND HEAD UNIT

[75] Inventors: Yuji Murata; Takeshi Fuse; Masami Furuya; Toshio Koyama, all of Ebina, Japan

[73] Assignee: Fuji Xerox Co., Ltd., Tokyo, Japan

[21] Appl. No.: 94,354

[22] Filed: Jul. 21, 1993

[30] Foreign Application Priority Data

Aug. 13, 1992 [JP] Japan ..... 4-216240

[51] Int. Cl.[6] ..... B41J 2/01

[52] U.S. Cl. ..... 347/19

[58] Field of Search ..... 347/19, 101, 16; 346/134; 400/708

[56] References Cited

U.S. PATENT DOCUMENTS 5,049,898 9/1991 Arthur et al. ..... 347/19
5,068,806 11/1991 Gatten ..... 346/140 R X
5,071,273 12/1991 Kato ..... 400/708 X
5,124,727 6/1992 Yamazaki ..... 346/134

FOREIGN PATENT DOCUMENTS 61-255867 11/1986 Japan .
3-247456 11/1991 Japan .

*Primary Examiner*—Benjamin R. Fuller
*Assistant Examiner*—N. Le
*Attorney, Agent, or Firm*—Oliff & Berridge

[57] ABSTRACT

An ink jet recording device having a capability of detecting the life of an ink jet recording head. The ink jet recording device includes a size sensor for generating a paper size signal relating to a size of a printing paper; a detecting device for detecting the number of print scans of the recording head; a converting device for counting the number of print scans detected by the detecting device without correction when the size of the printing paper is a predetermined paper size and for converting the number of print scans detected by the detecting device into the number of print scans corresponding to the predetermined paper size to count the converted number of print scans when the size of the printing paper is any size other than the predetermined paper size; an accumulating device for accumulating the number of print scans counted by the converting device; and a memory for storing the number of print scans accumulated by the accumulating device. The ink jet recording device further includes an informing device for informing the number of print scans accumulated by the accumulating device. Accordingly, the expiration of the life of the recording head can be easily and reliably predicted.

16 Claims, 8 Drawing Sheets

INK JET RECORDING DEVICE AND HEAD UNIT

BACKGROUND OF THE INVENTION

1. Field of the Invention

The present invention relates to an ink jet recording device, and more particularly to an ink jet recording device having a capability of detecting the life of an ink jet recording head.

2. Description of the Related Art

In a conventional ink jet recording device such as a thermal ink jet recording device designed to rapidly heat ink by a resistance heater provided in an ink jet recording head and thereby generate bubbles in the ink, a pressure of which functions to jet ink droplets from nozzles, the ink jet recording head is subjected to a stress due to heat, pressure or chemical reaction with the ink during the operation for a certain period of time. The stress causes an increase in resistance of the heater or rapid heating of the heater to scorch the ink. As a result, a jet quantity of the ink is decreased and a normal jetting operation cannot be achieved to remarkably reduce an image quality.

In Japanese Patent Laid-open Publication No. 61-55867, the abnormal condition of the heater is detected by providing means for detecting a current leaked from the heater through the ink, thereby detecting the life of the ink jet recording head from the current value detected by the detecting means.

However, in such a conventional life detecting method as described in Japanese Patent Laid-open Publication No. 61-255867, special work of making electrodes for leakage current detection at an ink jetting portion is necessary to cause an increase in cost. Further, so long as any abnormality of the heater does not occur, the life of the ink jet recording head cannot be detected. Thus, the expiration of the life of the ink jet recording head cannot be predicted.

In an integral type ink jet cartridge constructed integrally of an ink jet recording head and an ink tank, a residual ink detecting device for detecting a quantity of ink remaining in the ink tank is described in Japanese Patent Laid-open Publication No. 3-247456. The residual ink detecting device is designed to detect a residual quantity of ink having reached a predetermined value or less from a change in resistance between electrodes and then count the number of print scans or the number of printed sheets, thereby detecting an ink consumption. When the residual quantity of ink thus defined from the detected ink consumption becomes the predetermined value or less, the use of the ink jet cartridge is stopped to avoid a reduction in print quality.

In such an integral type ink jet cartridge including the ink jet recording head and the ink tank integral with each other, the ink tank cannot be removed from the ink jet recording head, so that when the ink contained in the ink tank is fully consumed, the life of the ink jet recording head expires. In other words, the detection of a residual quantity of the ink in the ink tank in such an integral type ink jet cartridge means the detection of the life of the ink jet cartridge.

However, the technique described in Japanese Patent Laid-open Publication No. 3-247456 has a problem similar to that of the technique described in Japanese Patent Laid-open Publication No. 61-255867. Further, the technique described in Japanese Patent Laid-open Publication No. 3-247456 is originally intended to prevent a reduction in print quality due to a decrease in residual quantity of ink, and it is not a technique of detecting the life of the ink jet recording head. In addition, the technique described in Japanese Patent Laid-open Publication No. 3-247456 is incapable of detecting the life of an ink jet recording head of a disassemblable type ink jet cartridge including the ink jet recording head and an ink tank removably mounted thereto.

It is considered that the method of detecting an ink consumption by merely counting the number of print scans or the number of printed sheets as described in Japanese Patent Laid-open Publication No. 3-247456 may be applied to the detection of the life of the ink jet recording head. That is, the number of operations of each nozzle per print scan or printed sheet is preliminarily expected and the number of serviceable operations of each nozzle is preliminarily defined. Then, the number of print scans or the number of printed sheets is counted to thereby detect the number of actual operations of each nozzle. When the number of actual operations detected above approaches the number of serviceable operations, it is determined that the life of the ink jet recording head has nearly expired.

However, in an ink jet recording device employing various kinds of printing paper having different sizes, the number of print dots of each nozzle (i.e., the number of operations of each nozzle) per print scan or printed sheet varies according to the difference in size of the printing paper, causing an increase in detection error of the life of the ink jet recording head.

SUMMARY OF THE INVENTION

It is accordingly an object of the present invention to provide an ink jet recording device which can predict or detect the life of an ink jet recording head.

It is another object of the present invention to provide an ink jet recording device which can predict or detect the life of an ink jet recording head in a disassemblable type ink jet cartridge from which an ink tank can be removed.

It is a further object of the present invention to provide an ink jet recording device which can reduce a detection error of the life of an ink jet recording head in using various sheets of printing paper having different sizes.

In accordance with a first aspect of the present invention, there is provided in an ink jet recording device including a head unit including a head supporting member and an ink jet recording head; the head supporting member having an ink joint adapted to communicate with an ink tank; the ink jet recording head having a heat sink fixed to the head supporting member, a head chip mounted on an end portion of the heat sink and having a plurality of ink nozzles, and an ink supply line for communicating the plurality of ink nozzles with the ink joint; and a head carriage for removably carrying the heat unit, the head carriage being reciprocatably driven in a horizontal scanning direction; the improvement comprising paper size signal generating means for generating a paper size signal relating to a size of a printing paper; scan quantity detecting means for detecting the number of print scans of the ink jet recording head; scan quantity converting means for counting the number of print scans detected by the scan quantity detecting means without correction when the size of the printing paper is a predetermined paper size and for converting the number of print scans detected by the scan quantity detecting means into the number of print scans corresponding to the predetermined paper size to count the converted number of print scans when the size of the printing paper is any size other than the predetermined paper size; scan quantity accumulating means for accumulating the number of print scans counted by the scan quantity converting means; and accumulated scan quantity storing means for storing the number of print scans accumulated by the scan quantity accumulating means.

The paper size signal generating means may be constructed of a size sensor located in a feed path of the printing paper to detect the size of the printing paper. Alternatively, it may be constructed of a manual input button for inputting the size of the printing paper.

The scan quantity detecting means may comprise print data detecting means for detecting whether print data is present and a scan quantity counter for counting the number of print scans of the recording head operated if the print data is present. The scan quantity detecting means and the scan quantity accumulating means may be constructed by using a microcomputer or a logic circuit.

The accumulated scan quantity storing means may be constructed of an EEPROM (electronically erasable and programmable read only memory), SRAM (static random access memory), etc.

In the ink jet recording device according to the first aspect of the present invention, the head carriage and the head unit mounted thereon are reciprocatively driven in the horizontal scanning direction. In such a scanning operation, ink is jetted from the plurality of ink nozzles of the head chip mounted on the heat sink at an end portion thereof, which is fixed to the head supporting member of the head unit. The ink is supplied from the ink tank through the ink joint and the ink supply line to the plurality of ink nozzles.

The paper size signal generating means generates a paper size signal relating to a size of a printing paper fed to a position opposed to the ink nozzles.

The scan quantity detecting means detects the number of print scans of the recording head scanning on the printing paper.

The scan quantity converting means counts the number of print scans detected by the scan quantity detecting means without correction when the size of the printing paper is a predetermined paper size, while converting the number of print scans detected by the scan quantity detecting means into the number of print scans corresponding to the predetermined paper size to count the converted number of print scans when the size of the printing paper is any size other than the predetermined paper size. The count value obtained by the scan quantity converting means is accumulated by the scan quantity accumulating means.

The accumulated scan quantity storing means stores the accumulated value (i.e., the accumulated number of print scans) obtained by the scan quantity accumulating means.

Thus, the number of print scans detected in printing on any printing paper having different sizes is converted into the number of print scans to be obtained in printing on a printing paper having a predetermined size. Then, the converted number of print scans is accumulated to be stored into the accumulated scan quantity storing means.

The accumulated number of print scans stored in the accumulated scan quantity storing means may be read out by suitable reading means.

The accumulated number of print scans, that is, the accumulated value of the number of print scans converted corresponding to the predetermined paper size, is a measure of detection of the life of the ink jet recording head for the following reason.

It is assumed that the predetermined paper size is A4, i.e., 210 mm×297 mm, for example.

Further, it is assumed that each of right and left margins in printing on the A4-size printing paper is 5 mm.

In this case, the length of print scan in a printable area of the printing paper in performing scanning one line is obtained as follows:

$$210\text{ mm}-5\text{ mm}-5\text{ mm}=200\text{ mm}$$

Assuming that the printing is performed at 300 dpi (dots per inch), the number of print dots over the length of print scan (one scan) is obtained as follows:

$$300\times(200/25.4)=2362\text{ (dots)}$$

In case of X % coverage (i.e., the proportion of the area of the print dots to the total printable area is X %), the number of dots in one scan in average by each ink nozzle is expressed as follows:

$$(2362\text{ dots})\times(X\ \%)$$

Accordingly, in case of 4% coverage (i.e., X=4), the number of print dots in one scan in average by each ink nozzle is obtained as follows:

$$2362\text{ dots}\times 0.04=\text{about }100\text{ dots}$$

Assuming that the average life of each ink nozzle of the ink jet recording head is $2\times10^8$ dots, the number of serviceable print scans is obtained as follows:

$$2\times10^8/100=2\times10^6$$

Accordingly, in case of printing with about 4% coverage in average, when the total number of print scans approaches $2\times10^6$, the life of the ink jet recording head nearly expires.

Consequently, the expiration of the life of the ink jet recording head can be predicted by reading the accumulated value of the number of print scans stored in the accumulated scan quantity storing means with use of suitable reading means.

Preferably, the ink jet recording device according to the first aspect of the present invention further comprises accumulated scan quantity informing means for informing the number of print scans accumulated by the scan quantity accumulating means.

The scan quantity informing means may be constructed of an LED (light emitting diode) indicator adapted to be flashed or lighted when the accumulated number of print scans exceeds a predetermined value. Alternatively, it may be constructed of a digital indicator for indicating the accumulated number of print scans.

With this construction, the scan quantity informing means for informing the accumulated number of print scans is provided in the ink jet recording device. Accordingly, the expiration of the life of the ink jet recording head can be easily predicted.

Preferably, the ink jet recording device according to the first aspect of the present invention further comprises head life set value storing means for storing a head life set value corresponding to a value obtained by dividing the number of expected serviceable operations of each of the ink nozzles by the number of expected operations of each ink nozzle operated per print scan for the predetermined paper size; and head life informing means for informing that a life of the ink jet recording head has nearly expired when a difference between the number of print scans accumulated by the scan quantity accumulating means and the head life set value stored in the head life set value storing means becomes a predetermined value.

The head life set value storing means may be constructed of a ROM (read only memory), EEPROM, etc.

The head life informing means may be constructed of an LED indicator, digital indicator, etc.

With this construction, the head life set value storing means previously stores a head life set value corresponding to a value obtained by dividing the number of expected serviceable operations of each ink nozzle by the number of expected operations of each ink nozzle operated per print scan for the predetermined paper size.

The head life informing means informs that the life of the ink jet recording head has nearly expired when the difference between the accumulated number of print scans and the head life set value becomes a predetermined value.

Accordingly, the approach of the end of the life can be reliably predicted.

Preferably, in the ink jet recording device according to the first aspect of the present invention, the accumulated scan quantity storing means comprises a memory mounted on the ink jet recording head.

The memory may be constructed of an EEPROM, SRAM, etc.

With this construction, the memory as the accumulated scan quantity storing means is mounted on the ink jet recording head.

Accordingly, when the ink jet recording head is removed from the head carriage and is delivered to a service station, sales agency, etc., the data (i.e., the accumulated number of print scans) stored in the memory is read out in the service station, etc. to thereby determine whether the recording head has been troubled or the life of the recording head has expired.

In accordance with a second aspect of the present invention, there is provided in an ink jet recording device including a head unit including a head supporting member and an ink jet recording head; the head supporting member having an ink joint adapted to communicate with an ink tank; the ink jet recording head having a heat sink fixed to the head supporting member, a head chip mounted on an end portion of the heat sink and having a plurality of ink nozzles, and an ink supply line for communicating the plurality of ink nozzles with the ink joint; and a head carriage for removably carrying the heat unit, the head carriage being reciprocatably driven in a horizontal scanning direction; the improvement comprising paper size signal generating means for generating a paper size signal relating to a size of a printing paper; sheet quantity detecting means for detecting the number of printed sheets of the printing paper; sheet quantity converting means for counting the number of printed sheets detected by the sheet quantity detecting means without correction when the size of the printing paper is a predetermined paper size and for converting the number of printed sheets detected by the sheet quantity detecting means into the number of printed sheets corresponding to the predetermined paper size to count the converted number of printed sheets when the size of the printing paper is any size other than the predetermined paper size; sheet quantity accumulating means for accumulating the number of printed sheets counted by the sheet quantity converting means; and accumulated sheet quantity storing means for storing the number of printed sheets accumulated by the sheet quantity accumulating means.

The paper size signal generating means may be constructed of a size sensor located in a feed path of the printing paper to detect the size of the printing paper. Alternatively, it may be constructed of a manual input button for inputting the size of the printing paper.

The sheet quantity detecting means may comprise print data detecting means for detecting whether print data is present and a sheet quantity counter for counting the number of printed sheets of the printing paper if the print data is present. The sheet quantity detecting means and the sheet quantity accumulating means may be constructed by using a microcomputer or a logic circuit.

The accumulated sheet quantity storing means may be constructed of an EEPROM, SRAM, etc.

In the ink jet recording device according to the second aspect of the present invention, the head carriage and the head unit mounted thereon are reciprocatively driven in the horizontal scanning direction. In such a scanning operation, ink is jetted from the plurality of ink nozzles of the head chip mounted on the heat sink at an end portion thereof, which is fixed to the head supporting member of the head unit. The ink is supplied from the ink tank through the ink joint and the ink supply line to the plurality of ink nozzles.

The paper size signal generating means generates a paper size signal relating to a size of a printing paper fed to a position opposed to the ink nozzles.

The sheet quantity detecting means detects the number of printed sheets of the printing paper scanned by the recording head.

The sheet quantity converting means counts the number of printed sheets detected by the sheet quantity detecting means without correction when the size of the printing paper is a predetermined paper size, while converting the number of printed sheets detected by the sheet quantity detecting means into the number of printed sheets corresponding to the predetermined paper size to count the converted number of printed sheets when the size of the printing paper is any size other than the predetermined paper size. The count value obtained by the sheet quantity converting means is accumulated by the sheet quantity accumulating means.

The accumulated sheet quantity storing means stores the accumulated value (i.e., the accumulated number of printed sheets) obtained by the sheet quantity accumulating means.

Thus, the number of printed sheets detected in printing on any printing paper having different sizes is converted into the number of printed sheets to be obtained in printing on a printing paper having a predetermined size. Then, the converted number of printed sheets is accumulated to be stored into the accumulated sheet quantity storing means.

The accumulated number of printed sheets stored in the accumulated sheet quantity storing means may be read out by suitable reading means.

The accumulated number of printed sheets, that is, the accumulated value of the number of printed sheets converted corresponding to the predetermined paper size, is a measure of detection of the life of the ink jet recording head for the following reason.

It is assumed that the predetermined paper size is A4, i.e., 210 mm×297 mm, for example.

Further, it is assumed that each of top and bottom margins in printing on the A4-size printing paper is 5 mm.

In this case, the print width in a vertical scanning direction on one sheet of the A4-size printing paper is obtained as follows:

$$297\text{ mm}-5\text{ mm}-5\text{ mm}=287\text{ mm}$$

Assuming that the printing is performed at 300 dpi, the number of print dots over the print width in the vertical scanning direction is obtained as follows:

$$300\times(287/25.4)=3390\text{ (dots)}$$

Assuming that the number of the ink nozzles of the recording head is 128 and these ink nozzles are arranged in line in the vertical scanning direction, the number of print scans necessary to print 3390 dots in the vertical scanning direction is obtained as follows:

$$3390/128=26.5$$

Accordingly, in case of X % coverage as mentioned above, the number of print dots in average by each ink nozzle to print on one sheet of the A4-size printing paper is expressed as follows:

$$(2362\text{ dots})\times(X\ \%)\times 26.5$$

For example, in case of 4% coverage (i.e., X=4), the number of print dots in average by each ink nozzle to print on one sheet of the A4-size printing paper is obtained as follows:

$$2362\text{ dots}\times 0.04\times 26.5=\text{about }2650\text{ dots}$$

Assuming that the average life of each ink nozzle of the ink jet recording head is $2\times10^8$ dots, the number of serviceable printed sheets is obtained as follows:

$$2\times10^8/2650=7.55\times10^4$$

Accordingly, in case of printing with about 4% coverage in average, when the total number of printed sheets approaches $7.55\times10^4$, the life of the ink jet recording head nearly expires.

Consequently, the expiration of the life of the ink jet recording head can be predicted by reading the accumulated value of the number of printed sheets stored in the accumulated sheet quantity storing means with use of suitable reading means.

Preferably, the ink jet recording device according to the second aspect of the present invention further comprises accumulated sheet quantity informing means for informing the number of printed sheets accumulated by the sheet quantity accumulating means.

The sheet quantity informing means may be constructed of an LED indicator adapted to be flashed or lighted when the accumulated number of printed sheets exceeds a predetermined value. Alternatively, it may be constructed of a digital indicator for indicating the accumulated number of printed sheets.

With this construction, the sheet quantity informing means for informing the accumulated number of printed sheets is provided in the ink jet recording device. Accordingly, the expiration of the life of the ink jet recording head can be easily predicted.

Preferably, the ink jet recording device according to the second aspect of the present invention further comprises head life set value storing means for storing a head life set value corresponding to a value obtained by dividing the number of expected serviceable operations of each of the ink nozzles by the number of expected operations of each ink nozzle operated per printed sheet for the predetermined paper size; and head life informing means for informing that a life of the ink jet recording head has nearly expired when a difference between the number of printed sheets accumulated by the sheet quantity accumulating means and the head life set value stored in the head life set value storing means becomes a predetermined value.

The head life set value storing means may be constructed of a ROM, EEPROM, etc.

The head life informing means may be constructed of an LED indicator, digital indicator, etc.

With this construction, the head life set value storing means previously stores a head life set value corresponding to a value obtained by dividing the number of expected serviceable operations of each ink nozzle by the number of expected operations of each ink nozzle operated per printed sheet for the predetermined paper size.

The head life informing means informs that the life of the ink jet recording head has nearly expired when the difference between the accumulated number of printed sheets and the head life set value becomes a predetermined value.

Accordingly, the approach of the end of the life can be reliably predicted.

Preferably, in the ink jet recording device according to the second aspect of the present invention, the accumulated sheet quantity storing means comprises a memory mounted on the ink jet recording head.

The memory may be constructed of an EEPROM, SRAM, etc.

With this construction, the memory as the accumulated sheet quantity storing means is mounted on the ink jet recording head.

Accordingly, when the ink jet recording head is removed from the head carriage and is delivered to a service station, sales agency, etc., the data (i.e., the accumulated number of printed sheets) stored in the memory is read out in the service station, etc. to thereby determine whether the recording head has been troubled or the life of the recording head has expired.

In accordance with a third aspect of the present invention, there is provided in a head unit including a head supporting member and an ink jet recording head; the head supporting member having an ink joint adapted to communicate with an ink tank; the ink jet recording head having a heat sink fixed to the head supporting member, a head chip mounted on an end portion of the heat sink and having a plurality of ink nozzles, and an ink supply line for communicating the plurality of ink nozzles with the ink joint; the head unit being removably mounted on a head carriage adapted to be reciprocatably driven in a horizontal scanning direction; the improvement comprising accumulated scan quantity memory for storing the accumulated number of print scans obtained by counting the detected number of print scans without correction when a size of a printing paper is a predetermined paper size and by converting the detected number of print scans into the number of print scans corresponding to the predetermined paper size when the size of the printing paper is any size other than the predetermined paper size.

In the head unit according to the third aspect of the present invention, the head carriage and the head unit mounted thereon are reciprocatively driven in the horizontal scanning direction. In such a scanning operation, ink is jetted from the plurality of ink nozzles of the head chip mounted on the heat sink at an end portion thereof, which is fixed to the head supporting member of the head unit. The ink is supplied from the ink tank through the ink joint and the ink supply line to the plurality of ink nozzles.

The accumulated scan quantity memory stores the accumulated number of print scans obtained by counting the detected number of print scans without correction when the size of the printing paper is a predetermined paper size and by converting the detected number of print scans into the number of print scans corresponding to the predetermined paper size when the size of the printing paper size is any size other than the predetermined paper size.

Accordingly, the expiration of the life of the ink jet recording head can be predicted by reading the accumulated value of the number of print scans stored in the accumulated scan quantity memory with use of suitable reading means.

Further, when the head unit is removed from the head carriage and is delivered to a service station, sales agency, etc., the data (i.e., the accumulated number of print scans) stored in the memory is read out in the service station, etc. to thereby determined whether the ink jet recording head has been troubled or the life of the recording head has expired.

Preferably, the head unit according to the third aspect of the present invention further comprises head life set value memory for storing a head life set value corresponding to a value obtained by dividing the number of expected serviceable operations of each of the ink nozzles by the number of expected operations of each ink nozzle operated per print scan for the predetermined paper size.

With this construction, the head life set value memory previously stores a head life set value corresponding to a value obtained by dividing the number of expected serviceable operations of each ink nozzle by the number of expected operations of each ink nozzle operated per print scan for the predetermined paper size.

Accordingly, the expiration of the life of the ink jet recording head can be easily predicted by reading the accumulated number of print scans stored in the accumulated scan quantity memory and the head life set value stored in the head life set value memory with use of suitable reading means and then comparing both the values.

In accordance with a fourth aspect of the present invention, there is provided in a head unit including a head supporting member and an ink jet recording head; the head supporting member having an ink joint adapted to communicate with an ink tank; the ink jet recording head having a heat sink fixed to the head supporting member, a head chip mounted on an end portion of the heat sink and having a plurality of ink nozzles, and an ink supply line for communicating the plurality of ink nozzles with the ink joint; the head unit being removably mounted on a head carriage adapted to be reciprocatably driven in a horizontal scanning direction; the improvement comprising accumulated sheet quantity memory for storing the accumulated number of printed sheets obtained by counting the detected number of printed sheets without correction when a size of a printing paper is a predetermined paper size and by converting the detected number of printed sheets into the number of printed sheets corresponding to the predetermined paper size when the size of the printing paper is any size other than the predetermined paper size.

In the head unit according to the fourth aspect of the present invention, the head carriage and the head unit mounted thereon are reciprocatively driven in the horizontal scanning direction. In such a scanning operation, ink is jetted from the plurality of ink nozzles of the head chip mounted on the heat sink at an end portion thereof, which is fixed to the head supporting member of the head unit. The ink is supplied from the ink tank through the ink joint and the ink supply line to the plurality of ink nozzles.

The accumulated sheet quantity memory stores the accumulated number of printed sheets obtained by counting the detected number of printed sheets without correction when the size of the printing paper is a predetermined paper size and by converting the detected number of printed sheets into the number of printed sheets corresponding to the predetermined paper size when the size of the printing paper size is any size other than the predetermined paper size.

Accordingly, the expiration of the life of the ink jet recording head can be predicted by reading the accumulated value of the number of printed sheets stored in the accumulated sheet quantity memory with use of suitable reading means.

Further, when the head unit is removed from the head carriage and is delivered to a service station, sales agency, etc., the data (i.e., the accumulated number of printed sheets) stored in the memory is read out in the service station, etc. to thereby determined whether the ink jet recording head has been troubled or the life of the recording head has expired.

Preferably, the head unit according to the fourth aspect of the present invention further comprises head life set value memory for storing a head life set value corresponding to a value obtained by dividing the number of expected serviceable operations of each of the ink nozzles by the number of expected operations of each ink nozzle operated per printed sheet for the predetermined paper size.

With this construction, the head life set value memory previously stores a head life set value corresponding to a value obtained by dividing the number of expected serviceable operations of each ink nozzle by the number of expected operations of each ink nozzle operated per printed sheet for the predetermined paper size.

Accordingly, the expiration of the life of the ink jet recording head can be easily predicted by reading the accumulated number of printed sheets stored in the accumulated sheet quantity memory and the head life set value stored in the head life set value memory with use of suitable reading means and then comparing both the values.

Other objects and features of the invention will be more fully understood from the following detailed description and appended claims when taken with the accompanying drawings.

DETAILED DESCRIPTION OF THE PREFERRED EMBODIMENTS

There will now be described a preferred embodiment of the present invention with reference to the drawings, in which arrows X1 and X2 are shown to direct the front and rear sides of the ink jet recording device, respectively, and arrows Y1 and Y2 are shown to direct the left and right sides of the ink jet recording device, respectively.

Figure 1:
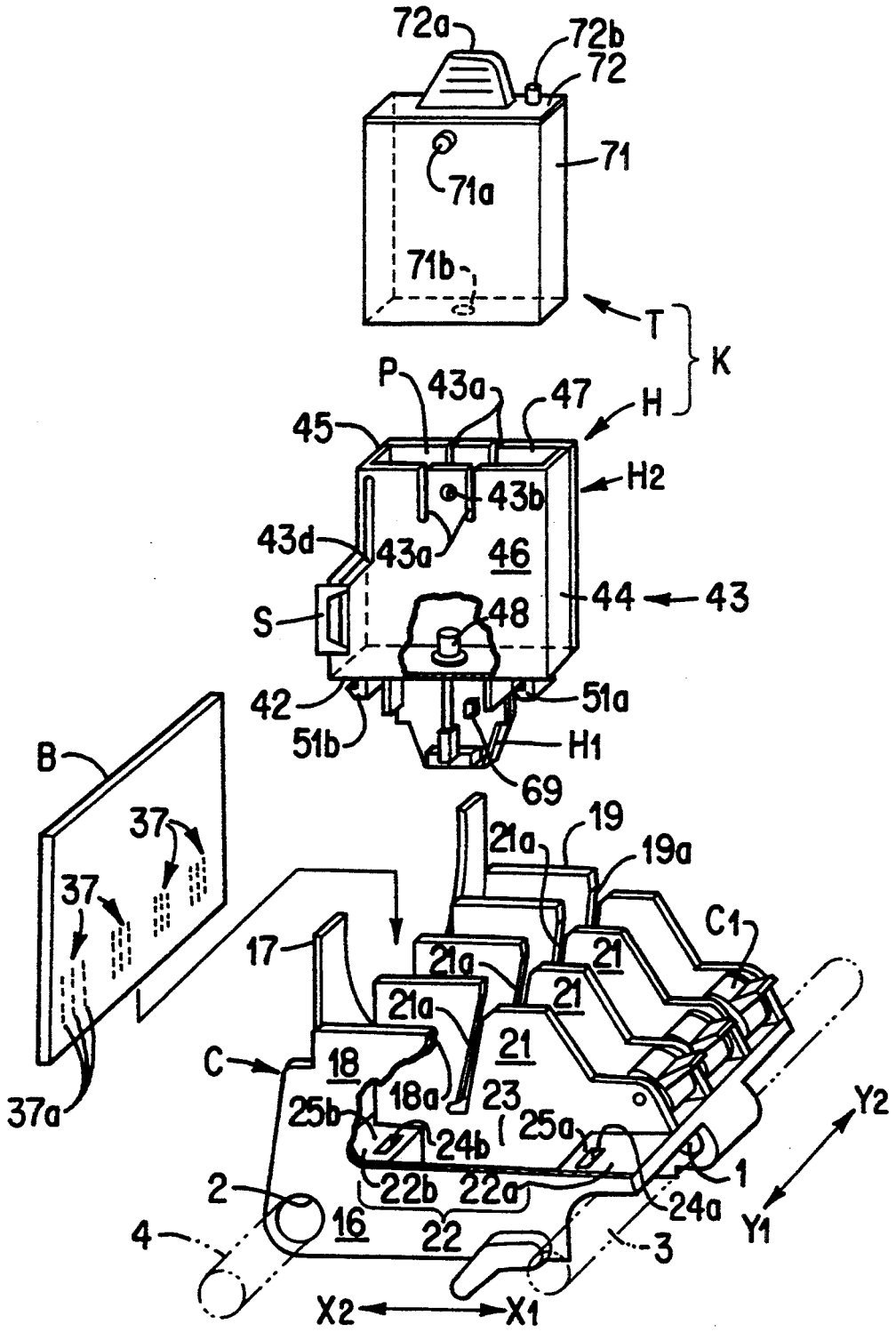
FIG. 1 is an exploded perspective view of an ink jet recording device according to a preferred embodiment of the present invention.

Referring now to FIG. 1, the ink jet recording device includes a head carriage C. The head carriage C is designed to carry four ink jet cartridges K (however, only one being shown for the purpose of simplicity of illustration) for respectively jetting yellow, magenta, cyan, and black inks from ink jet nozzles to effect printing.

Figure 2:
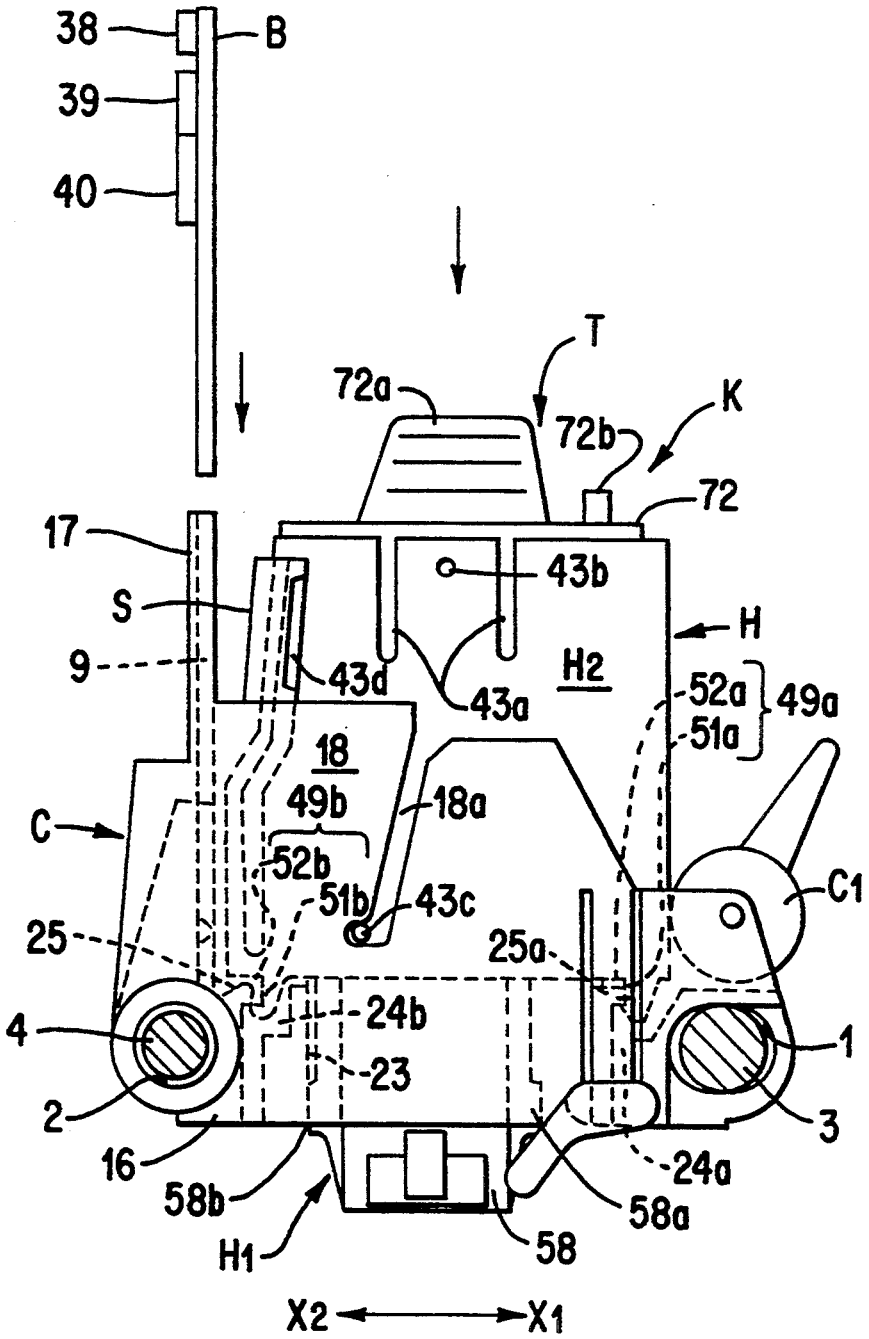
FIG. 2 is a side view of the ink jet recording device in the assembled condition thereof.

As shown in FIGS. 1 and 2, the ink jet cartridge K for each color ink is constituted of a head unit H and an ink tank T removably mounted therein. The head unit H is constituted of an ink jet recording head H1 and a tank holder H2 as a head supporting member. The ink tank T is removably mounted in the tank holder (i.e., head supporting member) H2. The ink jet cartridge K mounted on the head carriage C is urged rearwardly (in the direction X2) to be fixed to the head carriage C by rotating an eccentric cam lever C1 provided on the head carriage C.

However, various other known types of head carriages and ink jet cartridges rather than the head carriage C and the ink jet cartridges K mentioned above may be adopted according to the present invention.

Front and rear guide shaft holes 1 and 2 are formed through the lower portion of the head carriage C. The guide shaft holes 1 and 2 are slidably engaged with front and rear guide shafts 3 and 4 extending in the directions Y1–Y2, respectively.

The rear end of the head carriage C is connected to an endless timing belt (not shown). The endless timing belt is adapted to be reciprocatively driven by rotation of a carriage driving pulse motor (not shown) to reciprocate the head carriage C along the guide shafts 3 and 4 in the directions Y1–Y2.

Such a construction of reciprocating the head carriage C along the guide shafts 3 and 4 by means of the timing belt (driving belt) is known in the art.

There is provided under the guide shafts 3 and 4 a paper feeding device (not shown) for feeding a recording paper to a printing position and ejecting the recording paper to a receiving tray (not shown) after printing. Various known types may be used as the paper feeding device.

As shown in FIG. 1, the head carriage C has a carriage body 16. The carriage body 16 is formed with a rear wall 17, a left wall 18, and a right wall 19. The rear wall 17 extends upwardly from the upper surface of the carriage body 16 at the rear end portion thereof. The left wall 18 and the right wall 19 extend from the upper surface of the carriage body 16 at the left and right ends thereof, respectively. The left and right walls 18 and 19 serve as insert guide walls for guiding the ink jet cartridge K upon mounting the same into the head carriage C. The rear wall 17, the left wall 18 and the right wall 19 are perpendicular to the upper surface of the carriage body 16, and the left and right walls 18 and 19 are parallel to each other.

As shown in FIG. 1, three parallel intermediate walls 21 are provided between the left and right walls 18 and 19 in parallel relationship thereto. These intermediate walls 21 also serve as insert guide walls as similar to the left and right walls 18 and 19. All of the walls 18, 19 and 21 are equally spaced from each other. That is, the space between the adjacent ones of the walls 18, 19 and 21 is fixed. As shown in FIGS. 1 and 2, the walls 18, 19 and 21 are formed with holder guide slits **18*a*, 19*a* and 21*a*, respectively. Each holder guide slit extends downwardly from the upper end of each wall at the central position thereof. As will be hereinafter described, the holder guide slits 18*a*, 19*a* and 21*a* of the walls 18, 19 and 21 serve to guide the tank holder H2** upon mounting the ink jet cartridge K into the head carriage C.

The upper surface of the carriage body 16 is divided into four areas by the walls 18, 21 and 19, and each divided area defined between the adjacent ones of the walls 18, 21 and 19 is formed as a holder bottom supporting surface (i.e., tank holder mounting portion) 22. The holder bottom supporting surface 22 is constituted of a front portion **22*a* and a rear portion 22*b*, between which a head insert hole 23** is formed.

Thus, the upper surface of the carriage body 16 is formed into four divided holder bottom supporting surfaces (i.e., four divided tank holder mounting portions) 22 each having the head insert hole 23, and the four head units H for yellow, magenta, cyan and black inks are individually supported on the four divided holder bottom supporting surfaces 22 of the carriage body 16.

As shown in FIGS. 1 and 2, the front and rear portions **22*a* and 22*b* of each supporting surface 22 are formed with a pair of L-shaped hook receiving holes 24*a* and 24*b*, respectively, and with a pair of stop portions 25*a* and 25*b*** as means for preventing disengagement of each head unit H, respectively, which will be hereinafter described in detail.

As shown in FIGS. 1 and 2, four eccentric cam levers C1 are rotatably provided over the front portions **22*a* of the four holder bottom supporting surfaces 22 of the carriage body 16, respectively. The four eccentric cam levers C1 are rotatably supported on a single shaft extending in parallel to the guide shafts 3 and 4. Each eccentric cam lever C1 has a cam surface for rearwardly urging the corresponding tank holder H2**.

As shown in FIGS. 1 and 2, the rear ends of the left and right walls 18 and 19 are continuous to the rear wall 17, but the rear ends of the intermediate walls 21 are spaced from the rear wall 17 to define respective gaps G forming board insert slits for receiving a connection board B.

As shown in FIG. 1, the front surface of the connection board B is provided with four connection terminal portions 37 at the positions corresponding to the four holder bottom supporting surfaces 22. Each connection terminal portion 37 has a plurality of connection terminals 37*a*.

As shown in FIG. 2, a pin connector 38 and electronic parts 39 and 40 such as ICs are mounted on the rear surface of the connection board B. The pin connector 38 is connected through a connection cable (not shown) to a main board (not shown) in the ink jet recording device.

Now, the construction of the head unit H will be described in detail with reference to FIGS. 1 to 3.

The head unit H is constructed by integrally connecting the ink jet recording head H1 with the tank holder (head supporting member) H2. The tank holder H2 for removably holding the ink tank T includes a bottom wall 42 and a side wall 43 upwardly extending from the periphery of the bottom wall 42. The side wall 43 is constituted of a front wall 44, a rear wall 45, a left wall 46 and a right wall 47. The tank holder H2 has an upper opening P from which the ink tank T is adapted to be inserted.

The bottom wall 42 is provided with an ink joint 48 adapted to communicate with the ink tank T. Further, a pair of front and rear engaging members 49*a* and 49*b* are formed on the outer (lower) surface of the bottom wall 42.

The front engaging member 49*a* is constituted of an L-shaped hook 51*a* and a semispherical projection 52*a*. The L-shaped hook 51*a* has a leg portion projecting downwardly from the outer surface of the bottom wall 42 and an engaging portion extending rearwardly from the lower end of the leg portion in parallel to the outer surface of the bottom wall 42. The semispherical projection 52*a* is formed on the outer surface of the bottom wall 42 at the position opposed to the engaging portion of the L-shaped hook 51*a*.

Similarly, the rear engaging member 49*b* is constituted of an L-shaped hook 51*b* and two semispherical projections 52*b*. The L-shaped hook 51*b* has a leg portion and an engaging portion as similar to the L-shaped hook 51*a*. The two semispherical projections 52*b* are formed on the outer surface of the bottom wall 42 at the positions separate in the directions Y1–Y2 from the position opposed to the engaging portion of the L-shaped hook 51*b*.

As shown in FIG. 2, the ink jet cartridge K is mounted into the head carriage C in such a manner that the L-shaped hooks 51*a* and 51*b* of the tank holder H2 are inserted into the L-shaped hook receiving holes 24*a* and 24*b* of the carriage body 16 of the head carriage C, respectively, and that the stop portions 25*a* and 25*b* of the carriage body 16 are held between the engaging portion of the L-shaped hook 51*a* and the semispherical projection 52*a* and between the engaging portion of the L-shaped hook 51*b* and the semispherical projections 52*b*, respectively.

Each of the left wall 46 and the right wall 47 of the tank holder H2 is formed with two parallel slits 43*a* extending downwardly from the upper end. The two parallel slits 43*a* serve to provide an elasticity to a wall portion defined therebetween. A circular hole 43*b* is formed through the wall portion between the two parallel slits 43*a* of each of the left and right walls 46 and 47. The two circular holes 43*b* of the left and right walls 46 and 47 serve to position the ink tank T received into the tank holder H2.

Figure 3:
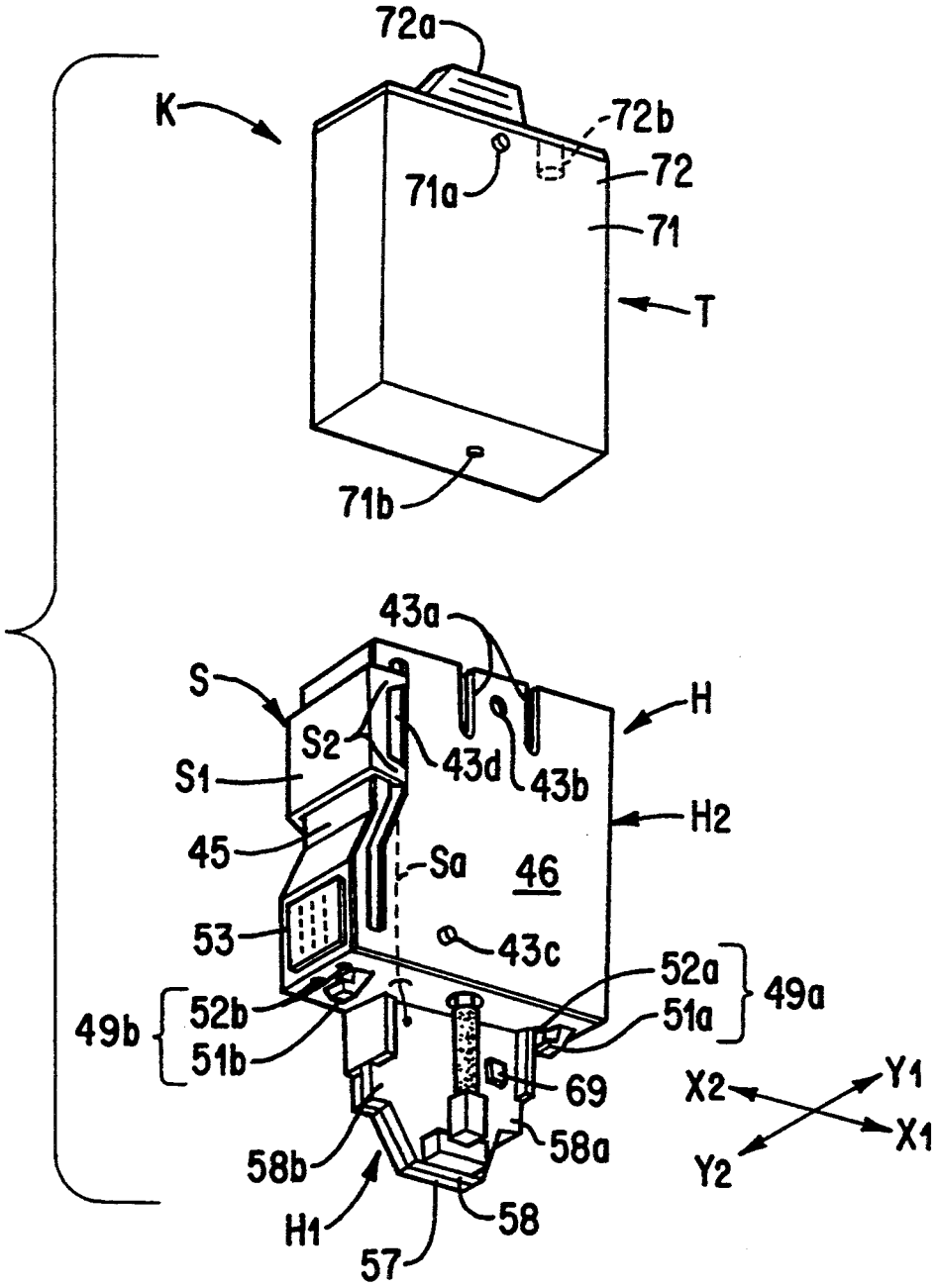
FIG. 3 is a perspective view of a head unit and an ink tank of the ink jet recording device.

Further, as shown in FIGS. 2 and 3, a guided projection 43*c* is formed on the outer surface of each of the left and right walls 46 and 47. The guided projection 43*c* is adapted to be engaged with the holder guide slit 18*a*, 19*a* or 21*a* of the head carriage C and be guided thereby in mounting the head unit H into the head carriage C.

Further, a shutter guide slit 43*d* is formed on the outer surface of each of the left and right walls 46 and 47 so as to extend along the rear wall 45. The shutter guide slit 43*d* serves to guide a shutter S slidably mounted on the rear wall 45 in mounting the head unit H into the head carriage C.

As best shown in FIG. 3, the shutter S includes a conductive cover plate S1 facing the rear wall 45 and two pairs of leg portions S2 projecting from the laterally opposite ends of the cover plate S1 in the direction X1 so as to grip the outer surfaces of the left and right walls 46 and 47 of the tank holder H2. Each leg portion S2 has a projection engaging with the shutter guide slit 43*d* and adapted to be guided therein. Further, a connection terminal plate 53 is mounted on a terminal mounting portion of the outer surface of the rear wall 45 at the lower end portion thereof. Thus, the shutter S is slidably supported to the tank holder H2 so as to be movable along the shutter guide slits 43*d* of the left and right walls 46 and 47 between a terminal covering position where the cover plate S1 of the shutter S covers the connection terminal plate 53 as shown in FIG. 1 and a terminal uncovering position where the cover plate S1 uncovers the connection terminal plate 53 as shown in FIGS. 2 and 3.

Further, as shown in FIG. 3, the shutter S is grounded through a conductive ground wire Sa to an aluminum heat sink (to be hereinafter described) of the ink jet recording head H1.

Figure 4A:
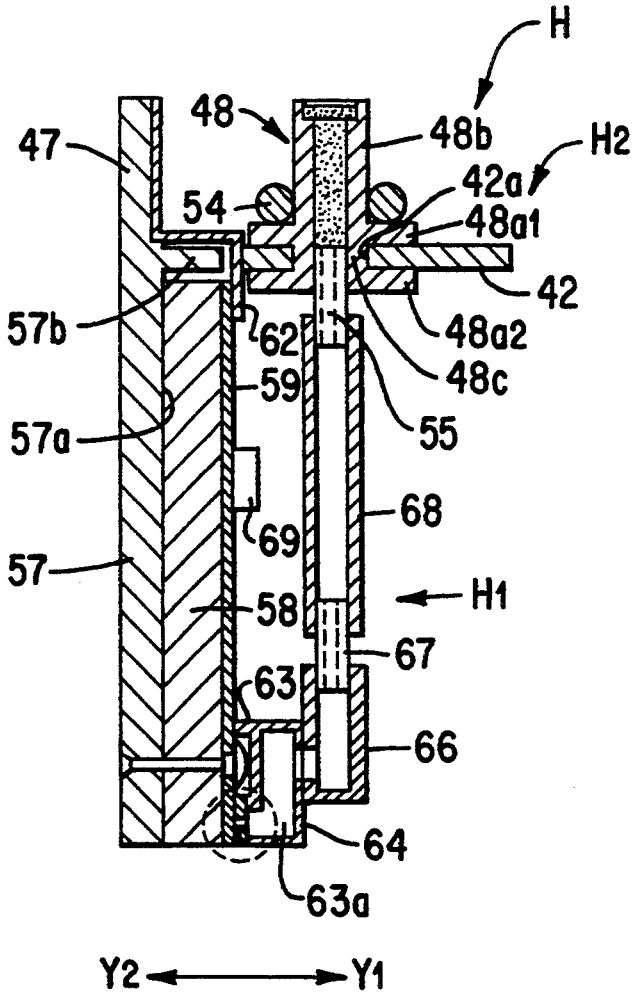
FIG. 4A is a vertical sectional view of an ink jet recording head of the ink jet recording device.

Referring to FIG. 4A, the ink joint 48 provided at the central portion of the bottom wall 42 of the tank holder H2 includes a pair of upper and lower large-diameter flanges $48a_1$ and $48a_2$ formed at the lower end portion, a small-diameter portion 48*b* extending upwardly from the upper large-diameter flange $48a_1$, and a small-diameter portion 48*c* formed between the upper and lower large-diameter flanges $48a_1$ and $48a_2$. The small-diameter portion 48*c* is fitted with a joint supporting hole 42*a* formed through the bottom wall 42, and the small-diameter portion 48*b* projects into the tank holder H2. A seal ring 54 is mounted on the lower end of the small-diameter portion 48*b* of the ink joint 48. The lower surface of the seal ring 54 is supported by the upper surface of the upper flange $48a_1$ of the ink joint 48. A first communication tube 55 is connected to the lower end of the ink joint 48.

The construction of the ink jet recording head H1 of the heat unit H will be described in detail.

Referring to FIGS. 1, 3 and 4A, the ink jet recording head H1 includes a substrate member 57 integrally formed with the right wall 47 of the tank holder H2. The side surface of the substrate member 57 directed by Y1, that is, the left side surface of the substrate member 57 is formed as a head supporting surface 57*a*, and a heat sink 58 made of aluminum is mounted on the head supporting surface 57*a*. The heat sink 58 functions to absorb and dissipate heat generating from heaters (not shown) in jetting the ink. As shown in FIGS. 2 and 3, the heat sink 58 has a pair of front and rear projections 58*a* and 58*b*. In particular, the rear projection 58*b* serves as a head positioning portion for positioning the rear end of the head unit H. That is, as shown in FIG. 2, when the head unit H is inserted into the head carriage C, the heat unit H is urged rearwardly by the eccentric cam lever C1, and the rear surface of the head positioning portion 58*b* abuts against the rear inside surface of the head insert hole 23 of the head carriage C, thereby positioning the rear end of the head unit H.

As shown in FIG. 4A, a wiring board 59 made of resin is bonded to the heat sink 58 except a lower end portion thereof. As will be hereinafter described with reference to FIG. 4B, a head chip 61 is bonded to the lower end portion of the heat sink 58.

A flexible cable 62 is connected at one end thereof to the upper end terminal portion of the wiring board 59 by means of a conductive adhesive. The flexible cable 62 extends beyond a partition wall 57*b* formed between the right wall 47 and the substrate member 57 to the inner surface of the right wall 47. The other end portion of the flexible cable 62 is connected to the connection terminal plate 53.

Figure 4B:
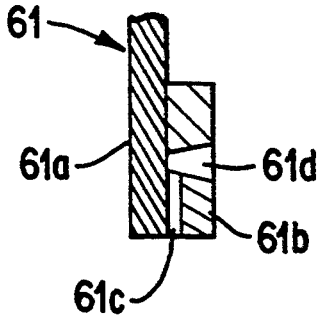
FIG. 4B is an enlarged view of a essential part shown in FIG. 4A.

As shown in FIGS. 4A and 4B, a manifold 63 is bonded to the outer side surface of the head chip 61 bonded to the lower end portion of the heat sink 58.

The head chip 61 is constituted of a heater substrate 61*a* bonded to the heat sink 58 and a channel substrate 61*b* fixed to the heater substrate 61*a* by means of a resin adhesive. Although not shown, a common electrode, a plurality of individual electrodes and a plurality of heaters (resistance heating elements) are formed on the outer surface of the heater substrate 61*a*.

The channel substrate 61*b* is formed with a plurality of channels respectively opposed to the plurality of heaters formed on the heater substrate 61*a*, so that a plurality of ink nozzles 61*c* are defined by the plurality of channels of the channel substrate 61*b* and the outer surface of the heater substrate 61*a*. The plurality of ink nozzles 61*c* are arranged in a direction perpendicular to the plane of the sheet of FIG. 4B.

The channel substrate 61*b* is further formed with an ink supply channel 61*d* communicating with each ink nozzle 61*c* and extending in the direction perpendicular to the plane of the sheet of FIG. 4B. The above construction of the head chip 61 is merely illustrative, and various other known constructions may be adopted.

As shown in FIG. 4A, the manifold 63 is provided with an ink storing chamber 63*a* communicating with the ink supply channel 61*d*. The ink storing chamber 63*a* is closed on the outer side thereof by a cover 64. Further, a hollow connecting member 66 is fixed to the cover 64 so as to communicate with the ink storing chamber 63*a*, and a second communication tube 67 is connected to the hollow connecting member 66. Further, an interconnection pipe 68 is connected between the first communication tube 55 and the second communication tube 67.

Thus, the components 55, 63, 64, and 66 to 68 constitute an ink supply line communicating the ink joint 48 to the ink nozzles 61*c* of the head chip 61.

As shown in FIGS. 3 and 4A, a life detection data memory 69 (as the accumulated scan quantity storing means according to the present invention) is mounted on the outer surface of the wiring board 59, i.e., on the left side surface directed by Y1. The life detection data memory 69 is connected through a printed wiring formed on the wiring board 59, the flexible cable 62 and the connection terminal plate 53 to the corresponding connection terminal portion 37 formed on the front surface of the connection board B. The connection terminal portion 37 is connected through the pin connector 38 mounted on the rear surface of the connection board B and the connection cable (not shown) to the main board (not shown) in the ink jet recording device.

Referring to FIGS. 1, 2 and 3, the ink tank T adapted to be removably mounted into the head unit H is constituted of a tank case 71 defining an ink storing space therein and a tank cover 72 covering the ink storing space of the tank case 71.

A pair of semispherical projections 71*a* are formed on the left and right side surfaces of the tank case 71 (i.e., the side surfaces adapted to be guided by the left and right walls 46 and 47 of the head unit H, respectively).

The semispherical projections 71*a* formed on the left and right side surfaces of the tank case 71 (i.e., the left and right side surfaces of the ink tank T) are adapted to engage with the circular holes 43*b* formed on the left and right walls 46 and 47 of the head unit H, respectively, thereby positioning the ink tank T mounted in the tank holder H2 of the head unit H.

The bottom surface of the tank case 71 (i.e., the bottom surface of the ink tank T) is formed with a circular through hole 71*b*, The circular through hole 71*b* is adapted to engage with the small-diameter portion 48*b* (see FIG. 4A) of the ink joint 48 projecting into the tank holder H2 of the head unit H in inserting the ink tank T into the tank holder H2. In the condition where the ink tank T is fully received in the tank holder H2, the outer periphery of the circular through hole 71*b* of the ink tank T is pressed against the upper surface of the seal ring 54 mounted on the ink joint 48, thereby preventing ink leakage from the joint portion between the ink tank T and the head unit H.

The tank cover 72 covering the ink storing space of the tank case 71 is fixed to the upper opening portion of the tank case 71 by means of adhesive or fusion. The tank cover 72 is provided with a tab 72*a* adapted to be gripped and pulled with fingers in removing the ink tank T from the head unit H. Further, the tank cover 72 is formed with an air vent 72*b* for communicating the inside of the ink tank T to the atmospheric air.

Now, a function of detecting the life of the ink jet recording head H1 of the ink jet recording device according to the preferred embodiment will be described with reference to FIG. 5.

Figure 5:
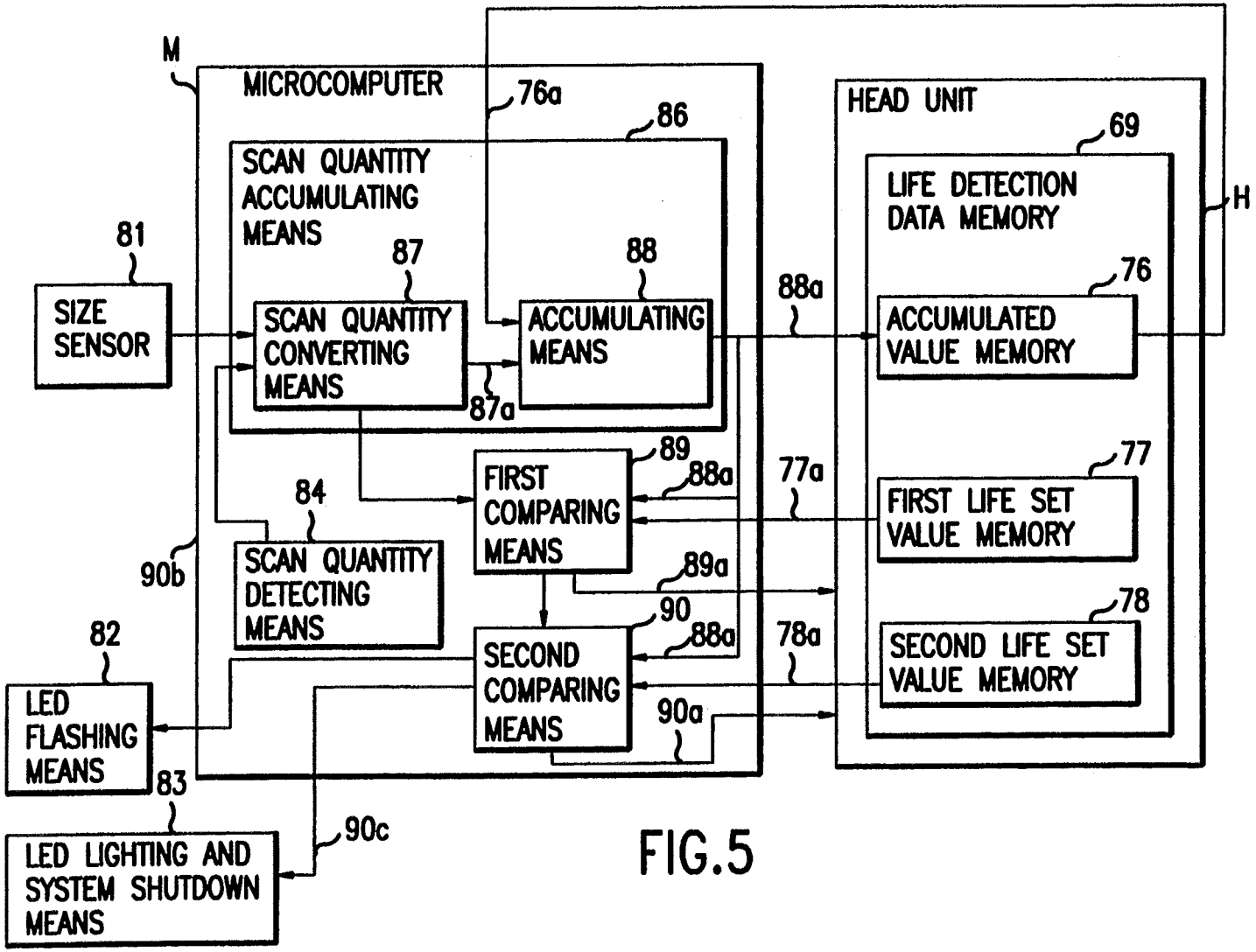
FIG. 5 is a block diagram illustrating a function of detecting the life of the ink jet recording head.

Referring to FIG. 5, the life detection data memory 69 mounted on the head unit H includes an accumulated value memory 76, a first life set value memory 77, and a second life set value memory 78. The first life set value memory 77 previously stores a first life set value 77*a* ($=2\times10^8\times0.98=1.8\times10^8$), and the second life set value memory 78 previously stores a second life set value 78*a* ($=2\times10^8\times0.98=1.96\times10^8$).

A main body of the ink jet recording device (i.e., any part other than the removable head unit H) is provided with a size sensor 81 for detecting a printing paper size, LED flashing means 82 for informing that the number of operations of the ink jet recording head H1 has exceeded the first life set value 77*a* ($=1.8\times10^8$), and LED lighting and system shutdown means 83 for informing that the number of operations of the ink jet recording head H1 has exceeded the second life set value 78*a* ($=1.96\times10^8$).

The size sensor 81 is constituted of a plurality of sensors located in the course of a printing paper feed path. Such a size sensor may be a sensor similar to a document size sensor located in a document feed path of a conventional automatic document feeder for a copying machine to detect a document size of a sheet document passing the document feed path.

Further, the main body of the ink jet recording device is provided with scan quantity detecting means 84. The scan quantity detecting means 84 is constituted of print data detecting means and a scan quantity counter. The print data detecting means functions to detect whether or not print data is present, and the scan quantity counter functions to count the number of print scans of the recording head H1 operated if the print data is present.

Further, the main body of the ink jet recording device is provided with scan quantity accumulating means 86. The scan quantity accumulating means 86 is constituted of scan quantity converting means 87 and accumulating means 88.

The scan quantity converting means 87 functions to convert the number of print scans counted by the scan quantity detecting means 84 according to the printing paper size detected by the size sensor 81 into the number of print scans according to a predetermined paper size. The scan quantity converting means 87 further functions to output to the accumulating means 88 a converted count value 87*a* obtained as the number of print scans according to the predetermined paper size and to also output to first comparing means 89 (to be hereinafter described) a signal indicating that the print scanning operation has been ended.

The accumulating means 88 functions to add the converted count value 87*a* to a previous accumulated value 76*a* stored in the accumulated value memory 76 and to output the sum of the values 76*a* and 87*a* as a current or update accumulated value 88*a* to the accumulated value memory 76*a*.

Further, the main body of the ink jet recording device is provided with first comparing means 89 and second comparing means 90.

The first comparing means 89 functions to compare the output value (i.e., the update accumulated value) 88*a* from the accumulating means 88 with the first life set value 77*a* stored in the first life set value memory 77 according to the signal received from the scan quantity converting means 87 (i.e., the signal indicating that the print scanning operation has been ended). If the result of comparison obtained by the first comparing means 89 is 88*a*≧77*a*, the first comparing means 89 functions to output a writing command signal 89*a* to the life detection data memory 69, while if the result of comparison is 88*a*≧77*a*, the first comparing means 89 functions to output a second comparing means operating command signal 89*b* to the second comparing means 90.

In receipt of the writing command Signal 89*a* from the first comparing means 89, the life detection data memory 69 functions to rewrite the previous accumulated value 76*a* stored in the accumulated value memory 76 into the update accumulated value 88*a* (i.e., the output value from the accumulating means 88).

The second comparing means 90 functions to compare the output value (i.e., the update accumulated value) 88*a* from the accumulating means 88 with the second life set value 78*a* stored in the second life set value memory 78 according to the signal received from the first comparing means 89 (i.e., the second comparing means operating command signal). If the result of comparison obtained by the second comparing means 90 is 88*a*<78*a*, the second comparing means 90 functions to output a writing command signal 90*a* to the life detection data memory 69 and to also output an LED flashing signal 90*b* for operating the LED flashing means 82, while if the result of comparison is 88*a*≧78*a*, the second comparing means 90 functions to output a shutdown signal 90*c* for operating the LED lighting and system shutdown means 83.

In receipt of the writing command signal 90*a* from the second comparing means 90, the life detection data memory 69 functions to rewrite the previous accumulated value 76*a* stored in the accumulated value memory 76 into the update accumulated value 88*a* (i.e., the output value from the accumulating means 88).

The functions of the components 84 and 86 to 90 as mentioned above are realized by using a microcomputer M in this preferred embodiment. However, the microcomputer M may be replaced by a wired logic circuit.

Figure 6:
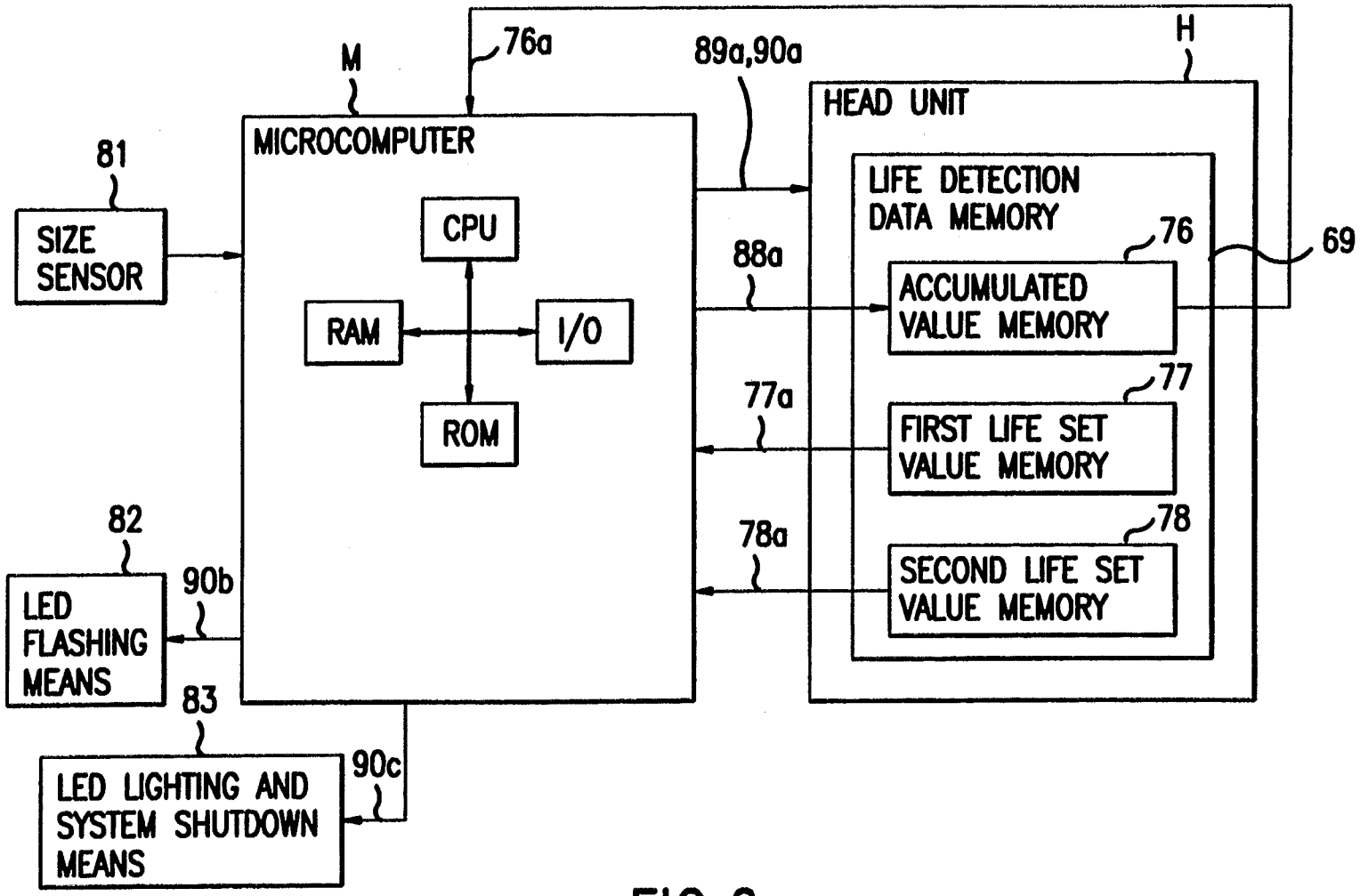
FIG. 6 is a block diagram illustrating a construction of the life detecting function shown in FIG. 5.

Referring to FIG. 6, the microcomputer M includes a central processing unit CPU, a read only memory ROM, a random access memory RAM, and an input/output interface I/O. A program, data, etc. stored in the read only memory ROM are processed by the central processing unit CPU and the random access memory RAM through the input/output interface I/O to realize the functions of the components 84 and 86 to 90 shown in FIG. 5.

The microcomputer M receives print data from a host computer, a size detection signal from the size sensor 81, the stored values 76*a*, 77*a* and 78*a* from the life detection data memory 69, etc.

Further, the scan quantity accumulated value 88*a* is generated from the microcomputer M to the life detection data memory 69. The LED flashing signal 90*b* and the system shutdown signal 90*c* are generated from the microcomputer M to the LED flashing means 82 and the LED lighting and system shutdown means 83.

Now, the operation of the ink jet recording device mentioned above will be described.

Referring to FIGS. 1 and 3, when the ink tank T is inserted into the head unit H toward the bottom wall 42 thereof, the ink tank T is guided along the inner surfaces of the left and right walls 46 and 47 of the head unit H. During the insertion of the ink tank T, the semispherical projections 71*a* formed on the opposite side surfaces of the ink tank T come into contact with the upper ends of the left and right walls 46 and 47. As the portions of the left and right walls 46 and 47 contacting with the projections 71*a* have an elasticity due to the formation of the parallel slits 43*a*, the wall portions are elastically deformed to open outwardly, thereby allowing the projections 71*a* to slip into the heat unit H.

When the ink tank T is further inserted toward the bottom wall 42 of the head unit H, the through hole 71*b* formed through the bottom surface of the ink tank T comes into close fit with the small-diameter portion 48*b* of the ink joint 48 projecting inwardly from the bottom wall 42. In this condition, the outer periphery of the through hole 71*b* is pressed against the seal ring 54 mounted on the ink joint 48, thereby preventing ink leakage from the joint portion between the ink tank T and the head unit H.

At the same time, the semispherical projections 71*a* of the ink tank T come into engagement with the circular holes 43b formed through the left and right walls 45 and 47, respectively.

In this manner, the bottom surface and the left and right side surfaces of the ink tank T are accurately positioned on the bottom wall 42 and the left and right walls 46 and 47 of the head unit H, respectively.

As shown in FIGS. 4A and 4B, the inside of the ink joint 48 is communicated through the first communication tube 55, the interconnection pipe 68, the second communication tube 67 and the connection member 66 to the ink storing chamber 63a of the manifold 63 closed by the cover 64. Further, the ink storing chamber 63a of the manifold 63 is communicated through the ink supply channel 61d of the head chip 61 to each ink nozzle 61c.

Accordingly, in the condition where the ink tank T is fully received into the head unit H as mentioned above, the ink contained in the ink tank T is supplied to each ink nozzle 61c of the ink jet recording head H1 and is jetted from the tip of each ink nozzle 61c (i.e., ink jet opening), thus effecting printing.

Before the head unit H is mounted into the head carriage C, the connection terminal plate 53 mounted on the rear wall 45 of the head unit H is protected by the shutter S. That is, the shutter S is normally located at the terminal covering position (see FIG. 1) to cover the connection terminal plate 53 mounted on the rear wall 45.

Accordingly, the connection terminal plate 53 is protected from contact with fingers in inserting the ink tank T into the head unit H.

When the ink jet cartridge K obtained by inserting the ink tank T into the head unit H is inserted into the head carriage C toward the holder bottom supporting surface 22 thereof, the ink jet cartridge K is guided along the adjacent ones of the left, intermediate and right walls 18, 21 and 19 of the head carriage C.

During the insertion of the ink jet cartridge K into the head carriage C, the shutter S located at the terminal covering position to cover the connection terminal plate 53 comes into abutment against the upper ends of the adjacent ones of the walls 18, 21 and 19. When the ink jet cartridge K is further inserted into the head carriage C, the shutter S abutting against the upper ends of the adjacent ones of the walls 18, 21 and 19 is moved along the shutter guide slits 43d from the terminal covering position (i.e., the lower position as shown in FIG. 1) to the terminal uncovering position (i.e., the upper position as shown in FIG. 2). Thus, the shutter S is automatically moved from the lower position shown in FIG. 1 to the upper position shown in FIG. 2.

In this manner, the connection terminal plate 53 normally covered with the shutter S is automatically uncovered in the insert operation of the ink jet cartridge K into the head carriage C.

At the same time, the guided projections 43c formed on the left and right walls 46 and 47 of the head unit H come into engagement with the adjacent ones of the holder guide slits 18a, 21a and 19a and are guide thereby.

Then, the bottom wall 42 of the head unit H reaches the holder bottom supporting surface 22 of the head carriage C. In this stage, the ink jet recording head H1 of the head unit H is inserted in the head insert hole 23 formed between the front and rear portions 22a and 22b of the supporting surface 22. Further, the front and rear L-shaped hooks 51a and 51b of the bottom wall 42 are inserted in the hook receiving holes 24a and 24b formed through the front and rear portions 22a and 22b of the supporting surface 22, respectively.

When the eccentric cam lever C1 is rotated to rearwardly urge the front surface of the ink jet cartridge K in the condition where the ink jet cartridge K is supported on the supporting surface 22 of the head carriage C, the ink jet cartridge K is rearwardly moved.

At this time, the rear surface of the head positioning portion 58b of the heat sink 58 comes into abutment against the rear inside surface of the head insert hole 23 of the head carriage C, thereby holding the ink jet cartridge K in position.

Further, at the same time, the connection terminal plate 53 mounted on the rear wall 45 of the heat unit H is automatically connected to the corresponding connection terminal portion 37 formed on the front surface of the connection board B.

Further, as shown in FIG. 2, the front and rear stop portions 25a and 25b of the head carriage C are held between the L-shaped hook 51a and the semispherical projection 52a of the front engaging member 49a and between the L-shaped hook 51b and the semispherical projections 52b of the rear engaging member 49b, respectively.

Such a condition where the stop portions 25a and 25b of the head unit H are held by the engaging members 49a and 49b, respectively, that is, where the engaging members 49a and 49b are engaged with the stop portions 25a and 25b, respectively, is a head mounted condition where the head unit H is completely mounted in the head carriage C.

The replacement of the empty ink tank T with another fresh one may be carried out under the head mounted condition.

Specifically, when the tab 72a of the ink tank T is pulled upwardly in the head mounted condition, the through hole 71b of the ink tank T is disengaged from the small-diameter portion 48b of the ink joint 48 of the head unit H with the head unit H kept mounted in the head carriage C. Accordingly, the ink tank T only is removed from the head unit H.

After removing the ink tank T from the head unit H, another fresh ink tank T is similarly inserted into the head unit H toward the bottom wall 42 thereof to connect the through hole 71b of the fresh ink tank T to the small-diameter portion 48b of the ink joint 48.

The replacement of the ink jet recording head H1 with another fresh one may be carried out by removing the head unit H from the head carriage C and then similarly mounting a fresh head unit H into the head carriage C.

Now, the operation of the functional components for detecting the life of the ink jet recording head H1 in the above preferred embodiment will be described with reference to the flowcharts shown in FIGS. 7 and 8. The processing shown in the flowcharts is executed according to the program stored in the read only memory ROM of the microcomputer M mentioned above.

Figure 7:
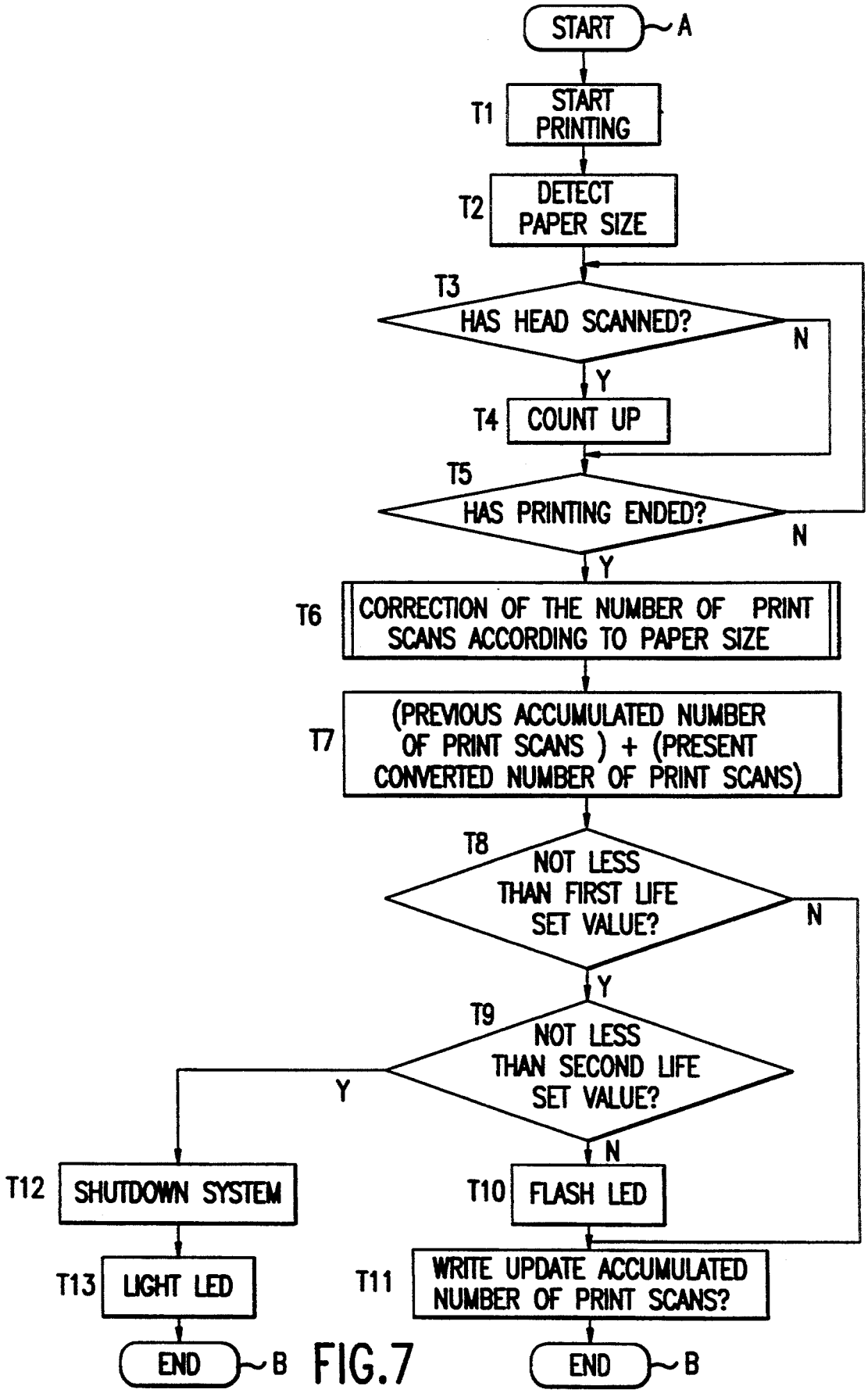
FIG. 7 is a flowchart of detection control of the life of the ink jet recording head.

Referring to FIG. 7, when printing is started in step T1, a printing paper is fed.

In step T2, the size of the printing paper is detected.

In step T3, it is determined whether or not scanning of the head Hi has been carried out. If the answer in step T3 is Yes, the number of print scans (SCAN) is counted up in step T4, and the program proceeds to step T5. If the answer in step T3 is No, the program proceeds directly to step T5.

In step T5, it is determined whether or not the printing has been ended. If the answer, in step T5 is No, the program returns to step T3. If the answer in step T5 is Yes, the program proceeds to step T6.

In step T6, the number of print scans counted according to the size of the printing paper detected is corrected.

Figure 8:
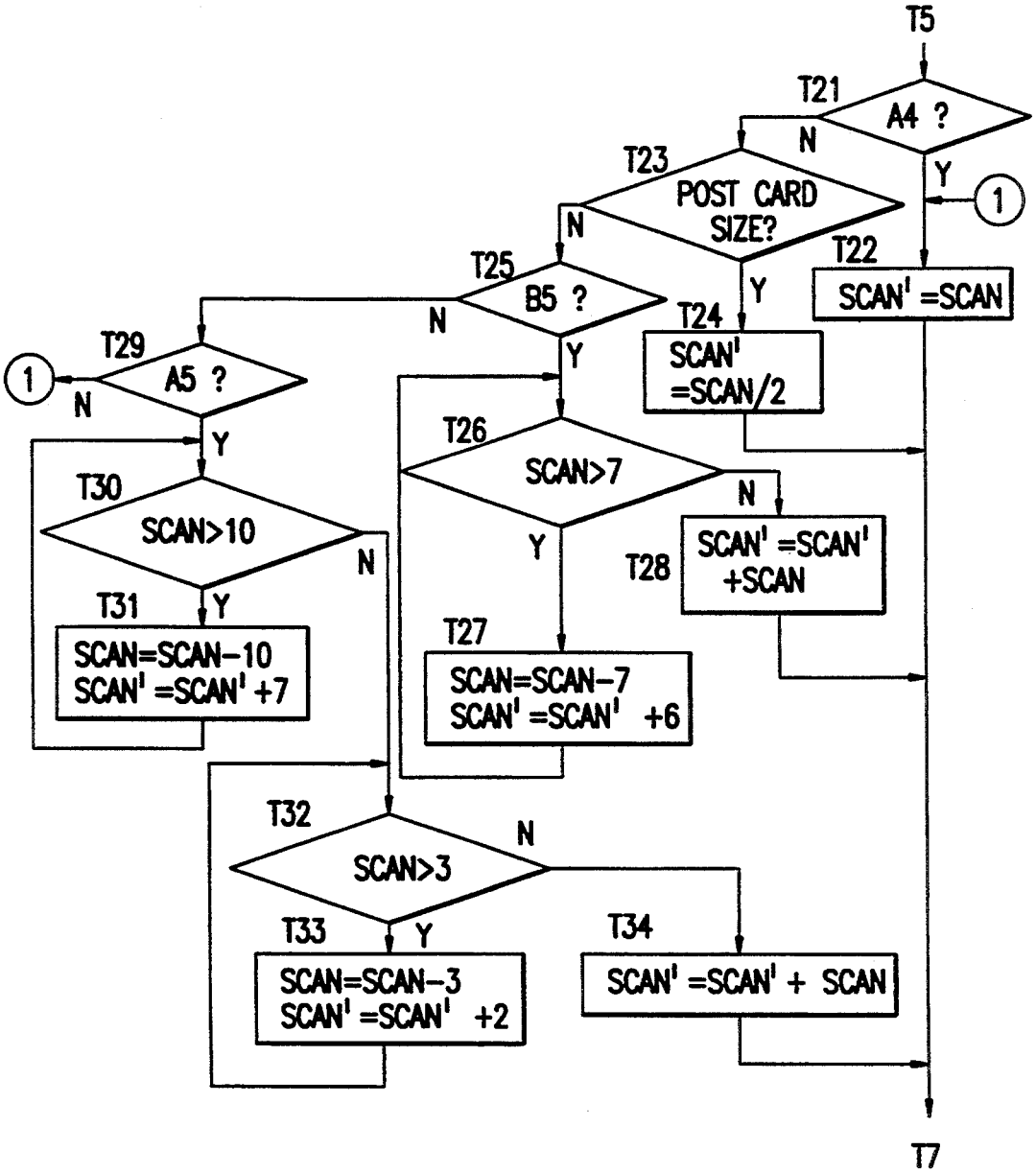
FIG. 8 is a flowchart illustrating the details of step T6 shown in FIG. 7.

Referring to FIG. 8 which shows the detailed flow of step T6, it is determined in step T21 whether or not the size of the printing paper is A4. If the answer in step T21 is Yes, the number of print scans (SCAN) counted in step T4 is adopted as the number of print scans (SCAN') converted corresponding to a predetermined paper size (A4).

Then, the program proceeds to step T7.

If the answer in step T21 is No, the program proceeds to step T23.

In step T23, it is determined whether or not the size of the printing paper is a post card size. This determination is performed according to a detection signal from the size sensor 81 located in the paper feed path.

If the answer in step T23 is Yes, the program proceeds to step T24.

In step T24, the number of print scans (SCAN) counted in step T4 is converted into the number of print scans (SCAN') corresponding to the predetermined paper size (A4) in accordance with the following expression.

$$SCAN' = SCAN \times \tfrac{1}{2}$$

Then, the program proceeds to step T7.

If the answer in step T23 is No, the program proceeds to step T25.

In step T25, it is determined whether or not the size of the printing paper is B5.

If the answer in step T25 is Yes, the program proceeds to step T26.

In step T26, it is determined whether or not the number of print scans (SCAN) counted in step T4 satisfies the following inequality.

$$SCAN > 7$$

If the answer in step T26 is Yes, the program proceeds to step T27. In step T27, the following computation is carried out.

$$SCAN = SCAN - 7$$

$$SCAN' = SCAN' + 6$$

where an initial value of SCAN' is 0.

Then, the program returns to step T26.

If the answer in step T26 is No, the program proceeds to step T28.

In step T28, the following computation is carried out.

$$SCAN' = SCAN' + SCAN$$

The value SCAN' obtained in step T28 is the number of print scans converted corresponding to the predetermined paper size (A4). Then, the program proceeds to step T7.

For example, it is assumed that the number of print scans (SCAN) counted in step T4 is 20. If the answer in step T25 in this case is Yes, the converted number of print scans (SCAN') is obtained in step T28 in the following manner.

Since the initial value of SCAN is 20, the answer in step T26 becomes Yes, and the program accordingly proceeds to step T27. In step T27, the following computation is carried out.

$$SCAN = 20 - 7 = 13$$

$$SCAN' = 0 + 6 = 6$$

Then, the program returns to step T26, and it is determined whether or not SCAN>7 is satisfied. Since SCAN=13 is now given, the answer in step T26 becomes Yes. Accordingly, the program proceeds to step T27, and the following computation is carried out.

$$SCAN = 13 - 7 = 6$$

$$SCAN' = 6 + 6 = 12$$

Then, the program returns to step T26, and it is determined whether or not SCAN>7 is satisfied. Since SCAN=6 is now given, the answer in step T26 becomes No. Accordingly, the program proceeds to step T28, and the following computation is carried out.

$$SCAN' = 12 + 6 = 18$$

Thus, the number of print scans 20 corresponding to the B5 size is converted into the number of scans 18 corresponding to the A4 size (i.e., the predetermined paper size).

If the answer in step T25 is No, the program proceeds to step T29.

In step T29, it is determined whether or not the size of the printing paper is A5.

If the answer in step T29 is No, the program proceeds to step T22. If the answer in step T29 is Yes, the program proceeds to step T30.

In step T30, it is determined whether or not the number of print scans (SCAN) counted in step T4 satisfies the following inequality.

$$SCAN > 10$$

If the answer in Step T30 is Yes, the program proceeds to step T31. In step T31, the following computation is carried out.

$$SCAN = SCAN - 10$$

$$SCAN' = SCAN' + 7$$

where an initial value of SCAN' is 0.

Then, the program returns to step T30.

If the answer in step T30 is No, the program proceeds to step T32.

In step T32, it is determined whether or not the number of print scans (SCAN) obtained in step T31 satisfies the following inequality.

$$SCAN > 3$$

If the answer in step T32 is Yes, the program proceeds to step T33. In step T33, the following computation is carried out.

$$SCAN = SCAN - 3$$

$$SCAN' = SCAN' + 2$$

where an initial value of SCAN' is the value SCAN' obtained in step T31.

Then, the program returns to step T32.

If the answer in step T32 is No, the program proceeds to step T34.

In step T34, the following computation is carried out.

$$SCAN' = SCAN' + SCAN$$

The value SCAN' obtained in step T34 is the number of print scans converted corresponding to the predetermined paper size (A4). Then, the program proceeds to step T7.

In step T7 shown in FIG. 7, the present converted value of the number of print scans is added to the previous accumulated value of the number of print scans to obtain an update accumulated value.

In step T8, it is determined whether or not the update accumulated value obtained in step T7 is not less than the first life set value. If the answer in step T8 is Yes, the program proceeds to step T9, while if the answer in step T8 is No, the program proceeds to step T11.

In step T9, it is determined whether or not the update accumulated value obtained in step T7 is not less than the second life set value. If the answer in step T9 is No, the program proceeds to step T10, while the answer in step T9 is Yes, the program proceeds to step T12.

In step T10, the LED is flashed to inform that the life has nearly expired.

In step T11, the update accumulated value obtained in step T7 is written into the accumulated value memory 76 in the life detection data memory 69, and the processing is ended.

On the other hand, in step T12, the system is shut down. Then, in step T13, the LED is lighted to inform that the life has completely expired.

Having thus described a specific preferred embodiment of the present invention, it is to be noted that the present invention is not limited to the above preferred embodiment, but various modifications may be made within the scope and spirit of the present invention set out in the accompanying claims.

For example, the life detection data memory 69 may be constituted of the accumulated value memory 76 only, and the first comparing means 89 and the second comparing means 90 may be omitted. In this case, it is preferable to provide means for displaying the accumulated value of the number of print scans converted corresponding to the predetermined paper size to always inform the current accumulated number of print scans. Also according to such a construction, the expiration of the life of the ink jet recording head can be predicted.

Further, means for storing an accumulated value of the number of printed sheets converted corresponding to a predetermined paper size rather than the accumulated value of the converted number of print scans may be provided to similarly predict the expiration of the life of the ink jet recording head.

What is claimed is:

1. In an ink jet recording device including:

a head unit including a head supporting member and an ink jet recording head; said head supporting member having an ink joint for communicating with an ink tank; said ink jet recording head having a heat sink fixed to said head supporting member, a head chip mounted on an end portion of said heat sink and having a plurality of ink nozzles, and an ink supply line for providing communication between said plurality of ink nozzles and said ink joint; and a head carriage for removably carrying said head unit, said head carriage being reciprocatably driven in a horizontal scanning direction;

the improvement comprising:

paper size signal generating means for generating a paper size signal relating to a size of a printing paper;

scan quantity detecting means for detecting a number of print scans of said ink jet recording head;

scan quantity accumulating means for accumulating a cumulative number of print scans; and scan quantity converting means 1) for adding to the cumulative number the number of print scans detected by said scan quantity detecting means without correction when the size of said printing paper is a predetermined paper size and 2) for converting the number of print scans detected by said scan quantity detecting means into a number of print scans corresponding to the predetermined paper size, to add to the cumulative number the converted number of print scans when the size of said printing paper is any size other than the predetermined paper size.

2. The ink jet recording device as defined in claim 1, further comprising:

accumulated scan quantity informing means for informing the number of print scans accumulated by said scan quantity accumulating means.

3. The ink jet recording device as defined in claim 2, further comprising accumulated scan quantity storing means for storing the cumulative number of print scans, the storing means comprising a memory mounted on said ink jet recording head.

4. The ink jet recording device as defined in claim 1, further comprising:

head life set value storing means for storing a head life set value corresponding to a value obtained by dividing a number of expected serviceable operations of each of said ink nozzles by a number of expected operations of said each ink nozzle operated per print scan for the predetermined paper size; and head life informing means for informing that a life of said ink jet recording head has nearly expired when a difference between the number of print scans accumulated by said scan quantity accumulating means and the head life set value stored in said head life set value storing means becomes a predetermined value.

5. The ink jet recording device as defined in claim 4, further comprising accumulated scan quantity storing means for storing the cumulative number of print scans, the storing means comprising a memory mounted on said ink jet recording head.

6. The ink jet recording device as defined in claim 1, further comprising accumulated scan quantity storing means for storing the cumulative number of print scans, the storing means comprising a memory mounted on said ink jet recording head.

7. In an ink jet recording device including:

a head unit including a head supporting member and an ink jet recording head; said head supporting member having an ink joint for communicating with an ink tank; said ink jet recording head having a heat sink fixed to said head supporting member, a head chip mounted on an end portion of said heat sink and having a plurality of ink nozzles, and an ink supply line for providing communication between said plurality of ink nozzles and said ink joint; and a head carriage for removably carrying said head unit, said head carriage being reciprocatably driven in a horizontal scanning direction;

the improvement comprising:

paper size signal generating means for generating a paper size signal relating to a size of a printing paper;

sheet quantity detecting means for detecting a number of printed sheets of said printing paper;

sheet quantity accumulating means for accumulating a cumulative number of printed sheets; and sheet quantity converting means 1) for adding to the cumulative number the number of printed sheets detected by said sheet quantity detecting means without correction when the size of said printing paper is a predetermined paper size and 2) for converting the number of printed sheets detected by said sheet quantity detecting means into a number of printed sheets corresponding to the predetermined paper size, to add to the cumulative number the converted number of printed sheets when the size of said printing paper is any size other than the predetermined paper size.

8. The ink jet recording device as defined in claim 7, further comprising:

accumulated sheet quantity informing means for informing the number of printed sheets accumulated by said sheet quantity accumulating means.

9. The ink jet recording device as defined in claim 8, further comprising accumulated sheet quantity storing means for storing the cumulative number of printed sheets, the storing means comprising a memory mounted on said ink jet recording head.

10. The ink jet recording device as defined in claim 7, further comprising:

head life set value storing means for storing a head life set value corresponding to a value obtained by dividing a number of expected serviceable operations of each of said ink nozzles by a number of expected operations of said each ink nozzle operated per printed sheet for the predetermined paper size; and head life informing means for informing that a life of said ink jet recording head has nearly expired when a difference between the number of printed sheets accumulated by said sheet quantity accumulating means and the head life set value stored in said head life set value storing means becomes a predetermined value.

11. The ink jet recording device as defined in claim 10, further comprising accumulated sheet quantity storing means for storing the cumulative number of printed sheets, the storing means comprising a memory mounted on said ink jet recording head.

12. The ink jet recording device as defined in claim 7, further comprising accumulated sheet quantity storing means for storing the cumulative number of printed sheets, the storing means comprising a memory mounted on said ink jet recording head.

13. In a head unit including a head supporting member and an ink jet recording head; said head supporting member having an ink joint for communicating with an ink tank; said ink jet recording head having a heat sink fixed to said head supporting member, a head chip mounted on an end portion of said heat sink and having a plurality of ink nozzles, and an ink supply line for providing communication between said plurality of ink nozzles and said ink joint; said head unit being removably mounted on a head carriage adapted to be reciprocatably driven in a horizontal scanning direction;

the improvement comprising:

accumulated scan quantity memory for storing an accumulated number of print scans, the accumulated number of print scans including the detected number of print scans without correction when a size of a printing paper is a predetermined paper size, the accumulated number of print scans including a converted number of print scans obtained by converting the detected number of print scans into a number of print scans corresponding to the predetermined paper size when the size of said printing paper is any size other than the predetermined paper size.

14. The head unit as defined in claim 13, further comprising:

head life set value memory coupled with said accumulated scan quantity memory for storing a head life set value corresponding to a value obtained by dividing a number of expected serviceable operations of each of said ink nozzles by a number of expected operations of said each ink nozzle operated per print scan for the predetermined paper size.

15. In a head unit including a head supporting member and an ink jet recording head; said head supporting member having an ink joint for communicating with an ink tank; said ink jet recording head having a heat sink fixed to said head supporting member, a head chip mounted on an end portion of said heat sink and having a plurality of ink nozzles, and an ink supply line for providing communication between said plurality of ink nozzles and said ink joint; said head unit being removably mounted on a head carriage adapted to be reciprocatably driven in a horizontal scanning direction;

the improvement comprising:

accumulated sheet quantity memory for storing an accumulated number of printed sheets, the accumulated number of printed sheets including the detected number of printed sheets without correction when a size of a printing paper is a predetermined paper size, the accumulated number of printed sheets including a converted number of printed sheets obtained by converting the detected number of printed sheets into a number of printed sheets corresponding to the predetermined paper size when the size of said printing paper is any size other than the predetermined paper size.

16. The head unit as defined in claim 15, further comprising:

head life set value memory coupled with said accumulated scan quantity memory for storing a head life set value corresponding to a value obtained by dividing a number of expected serviceable operations of each of said ink nozzles by a number of expected operations of said each ink nozzle operated per printed sheet for the predetermined paper size.

* * * * *